United States Patent [19]

Joanis, Sr.

[11] 4,292,704

[45] Oct. 6, 1981

[54] SEWER CLEANING BLADE STABILIZER

[76] Inventor: Marvin A. Joanis, Sr., 2211 Batson Ave., Rowland Heights, Calif. 91748

[21] Appl. No.: 145,963

[22] Filed: May 2, 1980

[51] Int. Cl.[3] ..... B08B 9/02

[52] U.S. Cl. ..... 15/104.3 SN; 15/104.1 R; 15/104.19

[58] Field of Search ..... 15/104.05, 104.09, 104.1 R, 15/104.12, 104.13, 104.14, 104.19, 104.2, 104.3 R, 104.3 SN

[56] References Cited

U.S. PATENT DOCUMENTS 1,132,690 3/1915 Sieben ..... 15/104.3 R X 2,062,850 12/1936 Weaver et al. ..... 15/104.12 X 2,232,018 2/1941 Wright ..... 15/104.12

*Primary Examiner*—Edward L. Roberts

[57] ABSTRACT

A stabilizer incorporated with a sewer pipe cleaning implement, wherein rotating blades scrape the pipe inner wall; the stabilizer including a spider having four spring-loaded arms that bear against the pipe wall, the spider being along a rubber-sleeved universal shaft assembly, wherein each universal joint thereof includes a block having a pair of transverse, longitudinally spaced-apart pivot pins at right angles to each other, and to which the joint links are pivoted.

3 Claims, 5 Drawing Figures

SEWER CLEANING BLADE STABILIZER

This invention relates generally to sewer pipe cleaning apparatus.

It is well-known, that conventional equipment used for clearing clogged drain pipes leading toward a sewer employ rotating blades, that are pushed through the pipeline, in order to scrape loose the sewage hardened therein, so as to allow sewage flow therethrough. When the blades hit a stoppage that resists the blades' rotating therethrough, the cable pushing the blades ahead builds up a torque force, causing the cable to twist itself into a knot, and locking the blade in the stoppage, by the blades becoming turned sideways, which often happens in such instances. Then it may take hours, trying to untwist the cable, in order to retrieve the equipment out of the pipeline. This time-consuming and objectionable situation is, accordingly, in need of an improvement.

Therefore, it is a principal object of the present invention to provide a sewer cleaning blade stabilizer, that keeps the blades in a straight line, and prevents them from turning sideways, when encountering a hard blockage or stoppage.

Another object, accordingly, is to provide a sewer cleaning blade stabilizer, which saves loss of time on a job, and extra expense for the lost time.

Other objects are to provide a sewer cleaning blade stabilizer, which is simple in design, inexpensive to manufacture, rugged in construction, easy to use, and efficient in operation.

These, and other objects, will be readily evident, upon a study of the following specification, and the accompanying drawing, wherein.

Figures 1, 2, 3, 4, 5:
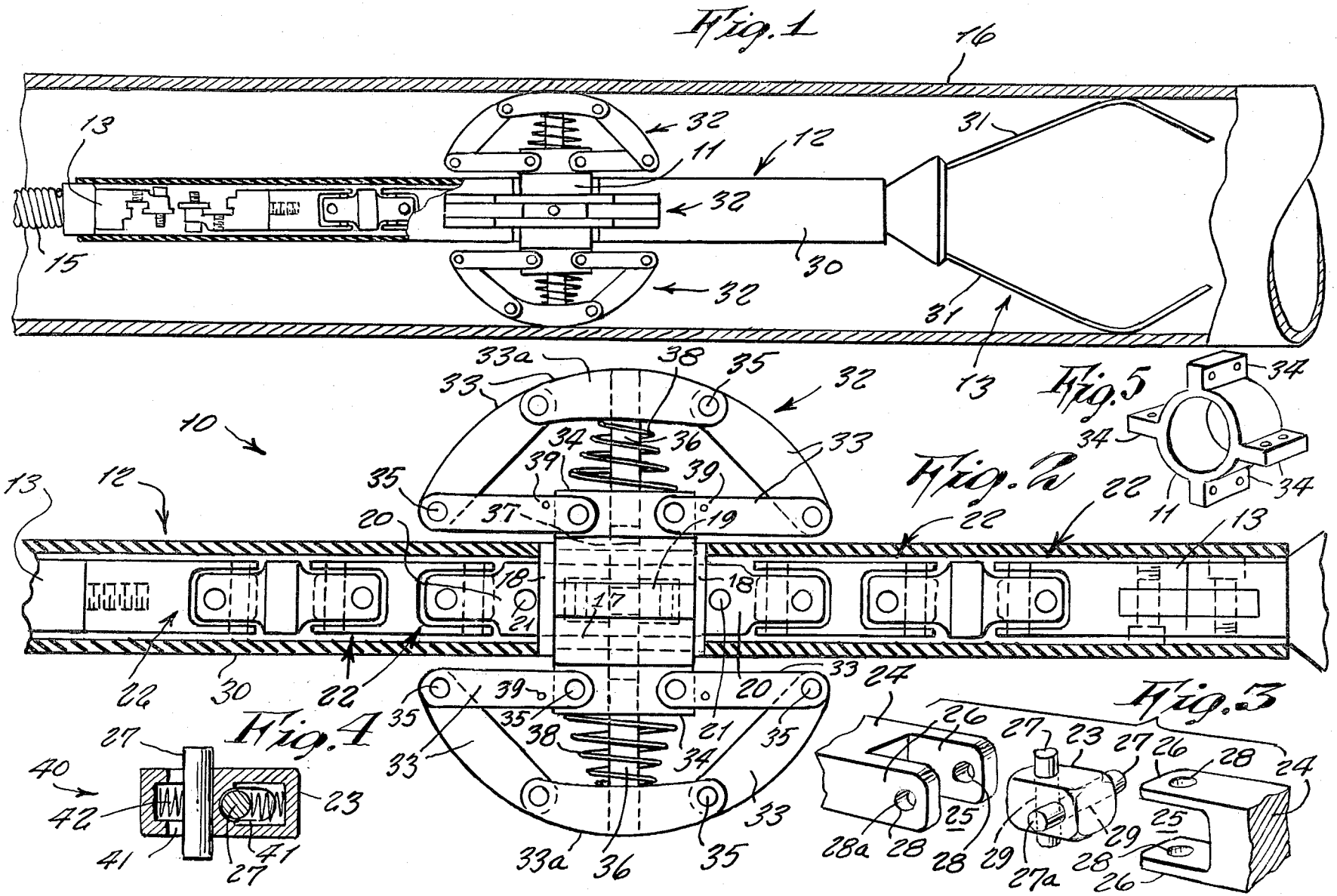
FIG. 1 is a side view of the invention, shown partly in cross-section, and installed in a sewer cleaning device that is illustrated in use.
FIG. 2 is an enlarged cross-sectional view of the blade stabilizer portion thereof.
FIG. 3 is an exploded perspective view of a typical universal joint thereof.
FIG. 4 is a side cross-sectional view of a modified design of the universal joint pivot block, in which the two cross pins can be selectively spread further apart, during a withdrawal of the device from a sewer pipe, so as to aid further in breaking up any knotting or twisting.
FIG. 5 is a perspective view of the spider of the device, shown alone.

Referring now to the drawing in greater detail, the reference numeral 10 represents a sewer cleaning blade stabilizer, according to the present invention, wherein there is a main body or spider 11, located along a universal shaft assembly 12, having coupling 13 at opposite ends, which are attached to a blade and chuck assembly 14, and an end of a long cable 15, that serves to push the blade and chuck assembly through a pipe 16, that is being cleaned out of clogging sewage.

The spider, made of aluminum, has a central hole 17 therethrough, with two Oilite shoulder bearings 18 on each side of the hole, and which support a stub center shaft 19. A universal joint half segment 20 is attached to each end of the stub central shaft, by means of a dowel pin 21, that also serves to hold the stub center shaft in the body of the spider.

A series of universal joints 22 are attached to each of the universal joint half segments, each joint 22 including a novel pivot block 23, which is pivotally grasped between two links 24, so as to comprise the universal joint. In this construction, each link includes a notch 25 formed between a pair of extensions 26 on the end of the link. A pin 27 extends transversely across the notch, and is secured, at its opposite ends, in a hole 28 in each of the extensions. The pivot block includes a pair of transverse extending holes 29 therethrough, for receiving the pins 27, the holes 29 being at right angles to each other, and located spaced apart a short distance along the longitudinal axis of the block. It is to be noted, from FIG. 3 of the drawing, that each link is pivotally connected to the pin 27, which extends across the bottom end of the notch of the other link. Thus, for example, individual hole 28*a* engages pin end 27*a*. Holes 29 are just off a longitudinal center of the block 23. This allows carrying increased torque load.

This construction differs from a conventional universal joint employed in such equipment, and wherein a cross-shaped pin engages all four holes 28 of the both links on a single transverse plane of the joint.

The universal shaft assembly includes a rubber sleeve 30, around the joints, so as to resist excessive flexing of the joints, and thus prevent the shaft assembly from twisting into a knot, when the blades 31 of assembly 13 meet excessive resistance of sewage against rotation thereof.

The spider includes four sets of arm assemblies 32, located ninety degrees apart around the spider.

Each arm assembly is comprised of five sets of segments 33, pivotally connected together at their ends, and to radially extending legs 34 of the spider, by means of roll pins 35. The outer peripheral side of the central segments is rounded arcuately, as shown in FIGS. 1 and 2. A guide shaft 36, secured at one end to the central segment 33*a*, is slidable, at its other end, in a radially extending opening 37, transversely through the spider. A compression coil spring 38, around the guide shaft, bears, at one end, against the spider, and bears, at its other end, against the central segment, so as to engage frictionally the inner surface of the pipe 16.

A stop pin 39 limits the outward expansion of the spring 38, and the arm assembly 32, so as to prevent disengagement of the guide shaft from the opening 37.

In operative use, it is now evident that the spaced-apart two pins 27, at each universal joint, and the rubber sleeve aid in carrying increased torque load, without turning of the blades sideways.

In FIG. 4, another design 40 of block 23 is shown, wherein the pins 27 can be selectively spread further apart during withdrawal of the device from a pipe, so as to aid further in breaking up any cable knotting; each pin in this design passing through a slot 41 of the block, instead of a tight fit hole 29, the slot containing a compression spring 42, that pushes the pins in a direction toward each other.

While various changes may be made in the detail construction, it is understood that such changes will be within the spirit and scope of the present invention as is defined by the appended claims.

What I now claim is:

1. A sewer cleaning blade stabilizer, comprising, in combination, a universal shaft assembly between a blade and chuck assembly, carrying rotating blades for scraping an inner side of a sewer pipeline, and a cable for pushing said blades through said pipeline; said universal shaft assembly comprising a row of links connected together by universal joints, and a stabilizer along said universal shaft assembly carrying spring loaded arms for frictionally engaging said pipeline inner side.

2. The combination as set forth in claim 1, wherein said universal shaft assembly includes a rubber sleeve therearound.

3. The combination as set forth in claim 2, wherein each said universal joint includes a block carrying a pair of spaced-apart pivot pins.

* * * * *